US005738347A

United States Patent [19]

Tognino

[11] Patent Number: 5,738,347

[45] Date of Patent: Apr. 14, 1998

[54] DEVICE FOR ADJUSTING THE SUCTION HEIGHT OF A SUCTION LIFTER IN THE FEEDER OF A SHEET-PROCESSING MACHINE

[75] Inventor: Michael Tognino, Walldorf, Germany

[73] Assignee: Heidelberger Druckmaschinen AG, Heidelberg, Germany

[21] Appl. No.: 671,795

[22] Filed: Jun. 24, 1996

[30] Foreign Application Priority Data

Jun. 23, 1995 [DE] Germany ..... 295 10 214 U

[51] Int. Cl.[6] ..... B65H 3/46

[52] U.S. Cl. ..... 271/106; 271/11; 271/93

[58] Field of Search ..... 271/11, 14, 96, 271/91, 93, 106, 107, 105

[56] References Cited

U.S. PATENT DOCUMENTS

| | | | |
|---|---|---|---|
| 2,086,577 | 7/1937 | Reinartz | 271/93 X |
| 4,589,649 | 5/1986 | Prescher | 271/107 |
| 4,940,221 | 7/1990 | Wirz et al. | 271/107 |
| 5,064,184 | 11/1991 | Liepert | 271/14 |
| 5,120,041 | 6/1992 | Schniter | 271/107 |
| 5,613,671 | 3/1997 | Fricke et al. | 271/107 X |

FOREIGN PATENT DOCUMENTS 976 134 3/1963 Germany .

*Primary Examiner*—Boris Milef

*Attorney, Agent, or Firm*—Herbert L. Lerner; Laurence A. Greenberg

[57] ABSTRACT

A suction lifter in a feeder of a sheet processing machine is cyclically reciprocated for separating and picking up sheets from a sheet pile and transferring them to a towing sucker. A suction lifter drive is operatively connected to the suction lifter and the suction height, i.e. the spacing between the lifter and the top sheet on the sheet pile, may be adjusted with the suction lifter drive. The drive is a control cylinder which rotates around a cylinder axis and which is axially shiftable along the axis for the purpose of adjusting the suction height of the suction lifter.

12 Claims, 2 Drawing Sheets

DEVICE FOR ADJUSTING THE SUCTION HEIGHT OF A SUCTION LIFTER IN THE FEEDER OF A SHEET-PROCESSING MACHINE

BACKGROUND OF THE INVENTION

1. Field of the Invention

The invention relates to a device for cyclically lifting and lowering (reciprocating) at least one suction lifter in the feeder of a sheet-processing machine with means for adjusting the suction height of the lifter.

2. Description of the Related Art

There has become known from German Patent DE-PS 976 134 an adjustment means at a suction lifter drive which allows a setting of a predetermined spacing in the suction position between the upper sheet surface and a suction lifter. The suction height must be adjustable particularly in the processing of printing materials of different thickness, e.g. ranging from ultra-thin airmail paper to heavy carton. The spacing must be relatively large in the case of airmail paper so that suction damage is prevented. In the case of heavy carton the spacing must be relatively small, so that the suction force is sufficient to securely attract the carton.

According to DE-PS 976 134 there is provided a suction lifter drive for adjusting the spacing between the sheet pile and the suction lifter in which an angle between a roller lever and an actuating lever is adjustable by means of an eccentric setting device.

It is a disadvantage in the device according to DE-PS 976 134 that, when the suction height is changed, a transfer position from the suction lifter to a following towing sucker is changed as well. The resulting misalignment may lead to transport and transfer problems.

SUMMARY OF THE INVENTION it is accordingly an object of the invention to provide a device for adjusting the suction height of a suction lifter in the feeder of a sheet-processing machine, which overcomes the above-mentioned disadvantages of the heretofore-known devices and methods of this general type and which allows setting a suction position of the suction lifter infinitely without changing the transfer position.

With the foregoing and other objects in view there is provided, in accordance with the invention, a device for cyclically reciprocating a suction lifter in a sheet processing machine, comprising:

- a suction lifter drive operatively connected to a suction lifter for cyclically aspirating and lifting sheets in a sheet processing machine;
- the drive includes a control cylinder rotatingly driven around a cylinder axis, the control cylinder being axially shiftable along the axis for adjusting a suction height of the suction lifter.

It is particularly advantageous in this invention that a sheet, which has been separated by the suction lifter and lifted from the sheet pile, can be dependably transferred to the towing sucker, because a setting to a different suction height does not alter the transfer position of the system.

Another advantage is found in the stationary disposition of the adjusting member. It is possible by way of this provision to also adjust the distance of the suction lifter from the top surface of the sheet even during processing. In accordance with an added feature of the invention the device includes a stationary adjusting member operatively engaging the control cylinder. In a preferred embodiment, the adjusting member is supported so as to be axially shiftable.

In accordance With another feature of the invention, the device includes a drive shaft drivingly supporting the control cylinder, and an adjusting member formed with a bearing for the drive shaft. In other words, the stationary adjusting member may be an adjuster bushing, the inner bore of which is provided as a bearing for the drive shaft of the control cylinder.

In accordance with an additional feature of the invention, the control cylinder is formed with a circumferential contour, the circumferential contour—with reference to the cylinder axis—having different radii in a first cam region and having different radii in a second cam region.

In accordance with again another feature of the invention, the circumferential contour of the control cylinder is formed with an incline from the first cam region to the second cam region, the incline connecting corresponding radii of the different radii.

In other words, the circumferential contour may, as seen in radial section, define a substantially semicircular running surface segment followed by a substantially semi-elliptical running surface segment. The incline, thereby, extends on the semi-elliptical running surface segment, while the radius of the semicircular running surface segment remains constant.

It is clearly advantageous to dispose the control cam of the suction lifter drive such that it can be brought into operative contact with the circumferential contour of the axially shiftable control cylinder. It is thus possible to infinitely adjust the suction position of the at least one suction lifter.

In accordance with again an additional feature of the invention, there is provided a cam roller in rolling contact with the circumferential contour of the control cylinder, the cam roller being in actuating relationship with the suction lifter for reciprocating the suction lifter in dependence on the circumferential contour of the control cylinder.

In accordance with a concomitant feature of the invention, the cam roller has a semicircular running surface, as seen in radial section. The semicircular rolling surface ensures superior rolling contact with the control cylinder, even in the incline of the camming surface.

Other features which are considered as characteristic for the invention are set forth in the appended claims.

Although the invention is illustrated and described herein as embodied in a device for adjusting the suction height of a suction lifter in the feeder of a sheet-processing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
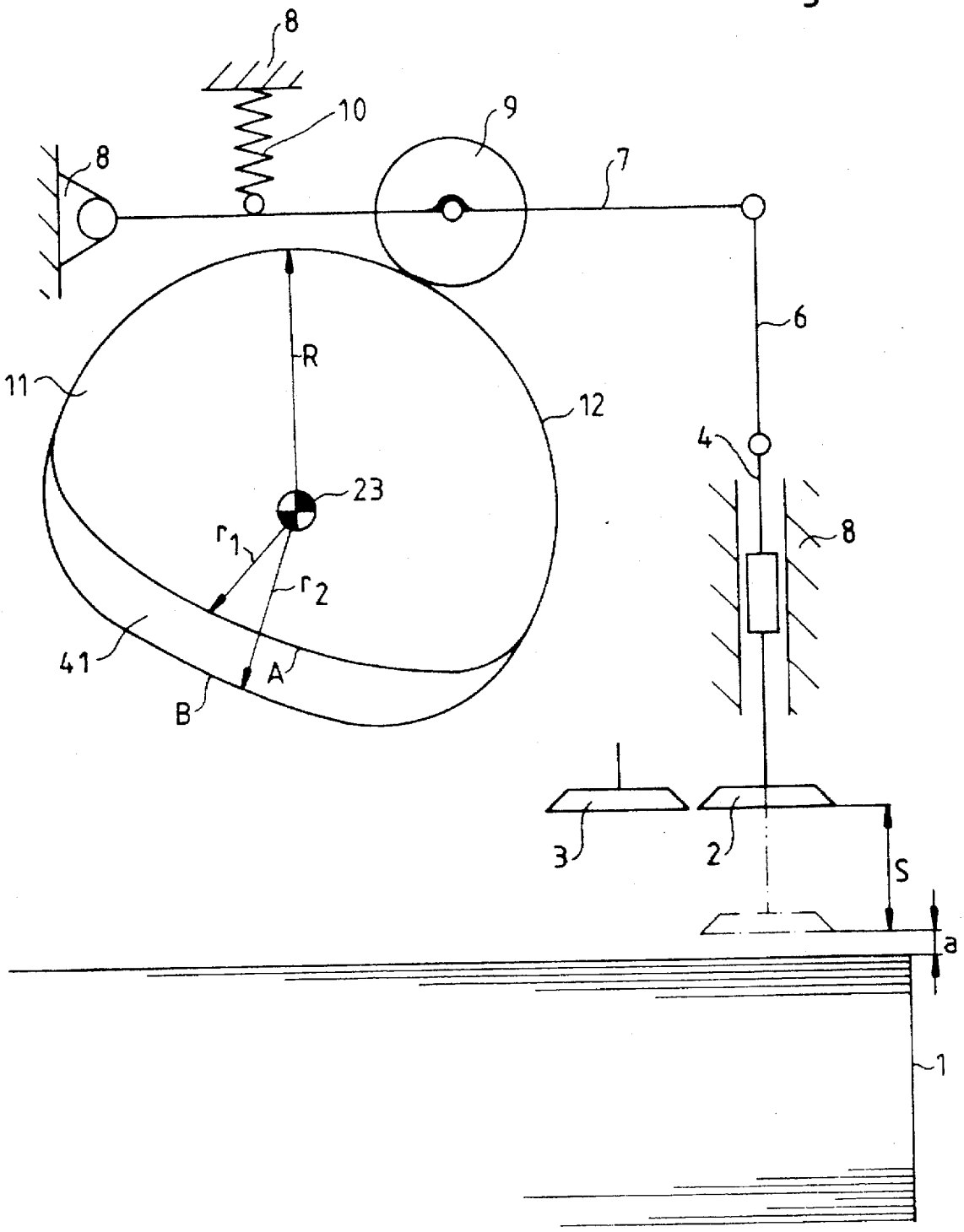
FIG. 1 is a schematic side view of a device according to the invention.

Referring now to the figures of the drawing in detail and first, particularly, to FIG. 1 thereof, there is seen a sheet pile 1 and a suction lifter 2 disposed above the sheet pile 1. A towing sucker 3 is disposed in a "transfer position" at the same level as the suction lifter 2.

The suction lifter 2 is vertically guided by a lifter carrier 4. A coupling lever 6 is articulated at an upper end of the lifter carrier 4 and the coupling lever 6 connects the lifter carrier 4 to an articulated joint at an end of a roller lever 7. The roller lever 7 is swivellably mounted at a drive housing 8 (suction head housing) and it carries a rotatably mounted cam roller 9.

Figure 2:
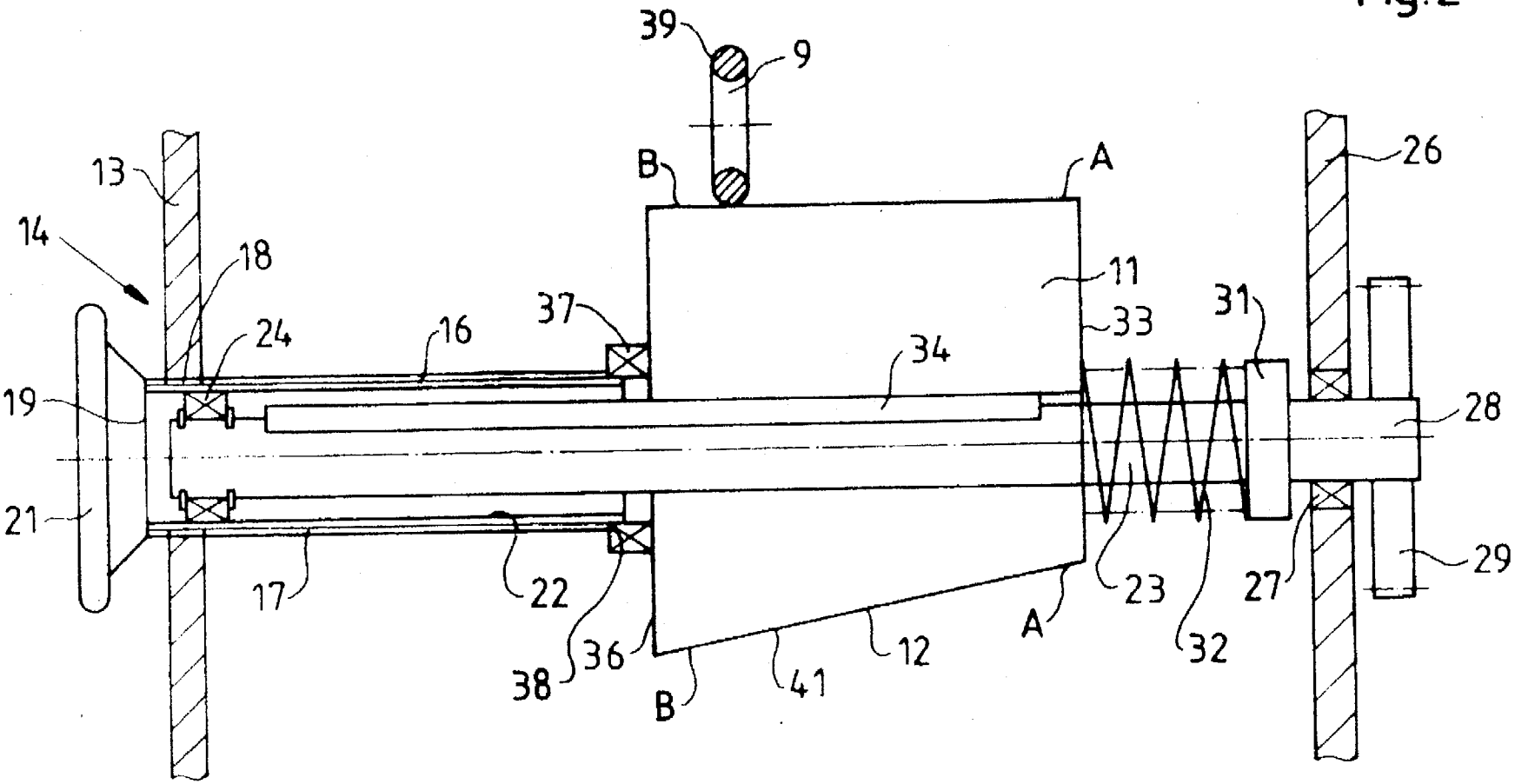
FIG. 2 is a schematic front view thereof.

The cam roller 9 is biassed by a spring 10 into permanent rolling contact with the circumferential contour of a control cylinder 11 (cam 11), which is driven at the speed of the sheet processing machine. The control cylinder 11 is mounted so as to be axially shiftable, so as to enable the cam roller 9 to be brought into rolling contact with all control cam regions A to B of the control cylinder 11 (FIG. 2).

If the suction lifter 2 is to be set to, say, carton transport mode, i.e. a minimum distance of the suction lifter 2 from the top surface of the sheet pile in its "suction position" is to be set, then the control cylinder 11 is shifted so far until the cam roller 9 rolls on a camming area A of the control cylinder 11.

If the suction lifter 2 is to be set to thin paper transport mode, i.e. a maximum distance of the suction lifter 2 from the top surface of the sheet pile in its "suction position" is to be set, the control cylinder 11 is axially shifted so far until the cam roller 9 rolls on a camming area B of the control cylinder 11. All of the camming areas between A and B can be infinitely adjusted.

The circumferential contour 12 of the control cylinder 11 has a constant radius R over about half the cylinder circumference, with which the cam roller 9 is in rolling contact while it is in the "transfer position". A radius $r_1 < r_2 < R$ is provided on the other half of the control cylinder circumference, during which the cam roller 9 is lowered into its lower position. In the lower position of the cam roller 9, the suction lifter is in its "suction position". The smaller radius $r_1$, $r_2$ (as compared to R) is nearly constant. The constant radii result in a virtual standstill of the suction lifter when it is in its "transfer position" (the constant radius R), and when it is in the "suction position" (the nearly constant radii $r_1$, $r_2$).

FIG. 2 shows an adjustment device 14 for the control cylinder which is mounted stationary in a side wall 13 of the drive housing 8.

The adjustment device 14 has an adjusting member in the form of an adjustment bushing 16, which is rotatably mounted with an outer thread 17 in a threaded bore 18 of the sidewall 13, and which is axially moved by means of the thread pitch.

The adjustment bushing 16 is provided with a hand wheel 21 at its end face outside the sidewall 13 for introducing the adjusting rotation.

A drive shaft 23 for the control cylinder 11 is rotatably mounted in a bearing 24 in an inner bore 22 of the adjustment bushing 16. The bearing 24 (e.g. an axial bearing) is fixed against axial shifting on the drive shaft 23, and it is mounted in the inner bore 22 so as to be axially shiftable relative to the adjustment bushing 16.

The drive shaft 23 is rotatably mounted (e.g. radial bearing 27) on the opposite side in a sidewall 26 of the drive housing 8, and it carries a drive wheel 29 (e.g. a sprocket gear) on a shaft journal 28 outside the sidewall 26.

A stop 31 (e.g. a shaft chamfer) is provided on the drive shaft 23 in immediate vicinity of the sidewall 26. The stop 31 serves as a counter bearing for a spring 32 that coaxially surrounds the drive shaft 23 and that is supported at the one end on the stop 31 and at the other end at a face end 33 of the control cylinder 11.

The control cylinder 11 does not rotate relative to the drive shaft 23, but it is axially shiftable. In the embodiment according to FIG. 2 there is provided an adjustment spring 34 for the shaft/hub connection between the drive shaft 23 and the control cylinder 11. A bearing 37 (e.g. axial bearing) is provided at a face end 36 of the control cylinder 11 which is distal from the face end 33. The bearing 37 is disposed between a ring face 38 of the adjustment bushing 16 and the face end 36 of the control cylinder 11.

The cam roller 9 has a semicircular running surface 39, as seen in section. This ensures good rolling contact of the cam roller 9 at an incline 41 between the cam regions A and B of the control cylinder 11.

In order to shift the control cylinder 11 axially, the hand wheel 21 is rotated in a clockwise or a counter-clockwise direction. Due to the thread pitch of the outer thread 17, the adjustment bushing 16 is axially shifted and it in turn pushes the control cylinder 11, when the hand wheel 21 is rotated in clockwise direction, by means of the bearing 37 against the spring force of the spring 32 in the direction of the drive wheel 29. The cam roller 9 thereby slides on the cam contour 12 of the control cylinder 11 in the axial direction to the cam region B.

The lifting path s of the suction lifter is relatively small here, i.e. a spacing a between the upper surface of a sheet on the sheet pile 1 and the bottom of the suction lifter 2 is relatively great, as it is required for processing airmail paper, for example.

When the handwheel 21 is adjusted in the counter-clockwise direction, then the spring 32 pushes the control cylinder 11 towards the left (in FIG. 2) in the direction of the handwheel 21, such that the cam roller 9 glides in the direction of the cam region A.

In a non-illustrated embodiment the control cylinder may also be provided with a cam lobe (cam elevation). The cam roller is thereby disposed below the control cylinder in such a manner that the cam lobe pushes the cam roller, and thus the suction lifter, downwardly into the "suction position". In that embodiment, the structural configuration of the cam lobe is essentially equivalent to the circumferential contour 12, however with a radius $r_{1,2} > R$.

I claim:

1. A device for cyclically reciprocating a suction lifter in a sheet processing machine, comprising:

a suction lifter drive operatively connected to a suction lifter for cyclically aspirating and lifting sheets in a sheet processing machine;

said drive including a control cylinder rotatingly driven around a cylinder axis, said control cylinder being axially shiftable along said axis for infinitely varying a suction height of the suction lifter.

2. The device according to claim 1, which further comprises a stationary adjusting member operatively engaging said control cylinder.

3. The device according to claim 2, wherein said adjusting member is axially shiftable.

4. The device according to claim 1, including a drive shaft drivingly supporting said control cylinder, and an adjusting member formed with a bearing for said drive shaft.

5. The device according to claim 1, wherein said control cylinder is formed with a circumferential contour, said circumferential contour, with reference to said cylinder axis, having different radii in a first cam region and having different radii in a second cam region.

6. The device according to claim 5, wherein said circumferential contour of said control cylinder is formed with an incline from said first cam region to said second cam region, said incline connecting corresponding radii of said different radii.

7. The device according to claim 5, which further comprises cam roller in rolling contact with said circumferential contour of said control cylinder, said cam roller being in actuating relationship with the suction lifter for reciprocating the suction lifter in dependence on said circumferential contour of said control cylinder.

8. The device according to claim 7, wherein said cam roller has a semicircular running surface, as seen in radial section.

9. The device according to claim 1, wherein said control cylinder is formed with a circumferential contour, said circumferential contour, as seen in radial section, defining a substantially semicircular running surface segment followed by a substantially semi-elliptical running surface segment.

10. The device according to claim 9, wherein said circumferential contour is formed with an incline from a first cam region at one axial end of said control cylinder to a second cam region at an opposite axial end thereof, a radius of said semicircular running surface segment being equal between said first and second cam segments, and a radius of said semi-elliptical running surface segment being smaller in said first cam region as compared to a radius in said second cam region.

11. The device according to claim 1, which further comprises a cam roller in rolling contact with said control cylinder, said cam roller being in actuating relationship with the suction lifter for reciprocating the suction lifter in dependence on a circumferential contour of said control cylinder.

12. The device according to claim 11, wherein said cam roller has a semicircular running surface, as seen in radial section.

* * * * *